US011794477B2

(12) United States Patent
Yamanaka

(10) Patent No.: US 11,794,477 B2
(45) Date of Patent: Oct. 24, 2023

(54) IMAGE FORMING APPARATUS, CONTROL METHOD AND NON-TRANSITORY RECORDING MEDIUM

(71) Applicant: Kunihiro Yamanaka, Kanagawa (JP)

(72) Inventor: Kunihiro Yamanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

(21) Appl. No.: 17/404,787

(22) Filed: Aug. 17, 2021

(65) Prior Publication Data

US 2022/0055372 A1 Feb. 24, 2022

(30) Foreign Application Priority Data

Aug. 19, 2020 (JP) ..... 2020-138640

(51) Int. Cl.
*B41J 2/165* (2006.01)
*B41J 2/21* (2006.01)
*B41J 2/045* (2006.01)

(52) U.S. Cl.
CPC ..... *B41J 2/165* (2013.01); *B41J 2/0456* (2013.01); *B41J 2/2103* (2013.01)

(58) Field of Classification Search
CPC ..... B41J 2/165; B41J 2/0456; B41J 2/2103
See application file for complete search history.

(56) References Cited

U.S. PATENT DOCUMENTS

| | | | | |
|---|---|---|---|---|
| 5,903,288 | A | 5/1999 | Yamaguchi | |
| 8,057,001 | B2 | 11/2011 | Shingyohuchi et al. | |
| 8,746,838 | B2 * | 6/2014 | Ito | B41J 2/16505 347/29 |
| 2004/0218003 | A1 * | 11/2004 | Monclus | B41J 2/16508 347/35 |
| 2016/0355012 | A1 | 12/2016 | Katoh et al. | |
| 2019/0030902 | A1 * | 1/2019 | Enjo | B41J 2/16526 |

FOREIGN PATENT DOCUMENTS

| | | |
|---|---|---|
| JP | H09-254375 | 9/1997 |
| JP | 2017-001242 | 1/2017 |

* cited by examiner

*Primary Examiner* — Justin Seo
(74) *Attorney, Agent, or Firm* — Duft & Bornsen, PC

(57) ABSTRACT

An image forming apparatus for forming an image with a coloring material on a recording medium includes a region specifier that specifies a region that becomes a margin when the image is formed on the recording medium; and a pattern image generator that generates image data of a pattern image to be formed in the region based on a size of the region and a type of the coloring material.

20 Claims, 11 Drawing Sheets

IMAGE FORMING APPARATUS, CONTROL METHOD AND NON-TRANSITORY RECORDING MEDIUM

CROSS-REFERENCE TO RELATED APPLICATION

The present application claims priority under 35 U.S.C. § 119 to Japanese Patent Application No. 2020-138640, filed Aug. 19, 2020. The contents of which are incorporated herein by reference in their entirety.

BACKGROUND OF THE INVENTION

1. Field of the Invention

The disclosures herein generally relate to an image forming apparatus, a control method and a non-transitory recording medium.

2. Description of the Related Art

Conventionally, image forming apparatuses that discharge coloring materials, such as liquid drops, onto regions, in which images are not formed, between conveyed recording media (between pages), or the like have been known.

Moreover, a configuration of eliminating an interruption of an image formation by specifying a region that becomes a margin when forming an image on a recording medium based on a predetermined pattern data, and discharging a coloring material onto the region so as to enhance an image formation speed, has been disclosed (See, for example, Japanese unexamined patent application publication No. H09-254375).

SUMMARY OF THE INVENTION

Problem to be Solved by the Invention

However, in the conventional configurations, an amount of a coloring material to be discharged onto a region that becomes a margin when an image is formed on a recording medium may not be optimized for each type of the coloring material.

An aspect of the present invention aims at providing a configuration of optimizing an amount of a coloring material to be discharged onto a region that becomes a margin when an image is formed on a recording medium for each type of the coloring material.

Means for Solving the Problem

According to an aspect of the present disclosure, an image forming apparatus for forming an image with a coloring material on a recording medium includes a region specifier that specifies a region that becomes a margin when the image is formed on the recording medium; and a pattern image generator that generates image data of a pattern image to be formed in the region based on a size of the region and a type of the coloring material.

Effect of the Invention

According to an aspect of the present disclosure, an amount of the coloring material to be discharged onto a region that becomes a margin when an image is formed on a recording medium can be optimized for each type of the coloring material.

BRIEF DESCRIPTION OF THE DRAWING

Other objects and further features of the present invention will be apparent from the following detailed description when read in conjunction with the accompanying drawings, in which.

DESCRIPTION OF THE PREFERRED EMBODIMENTS

Figure 1:
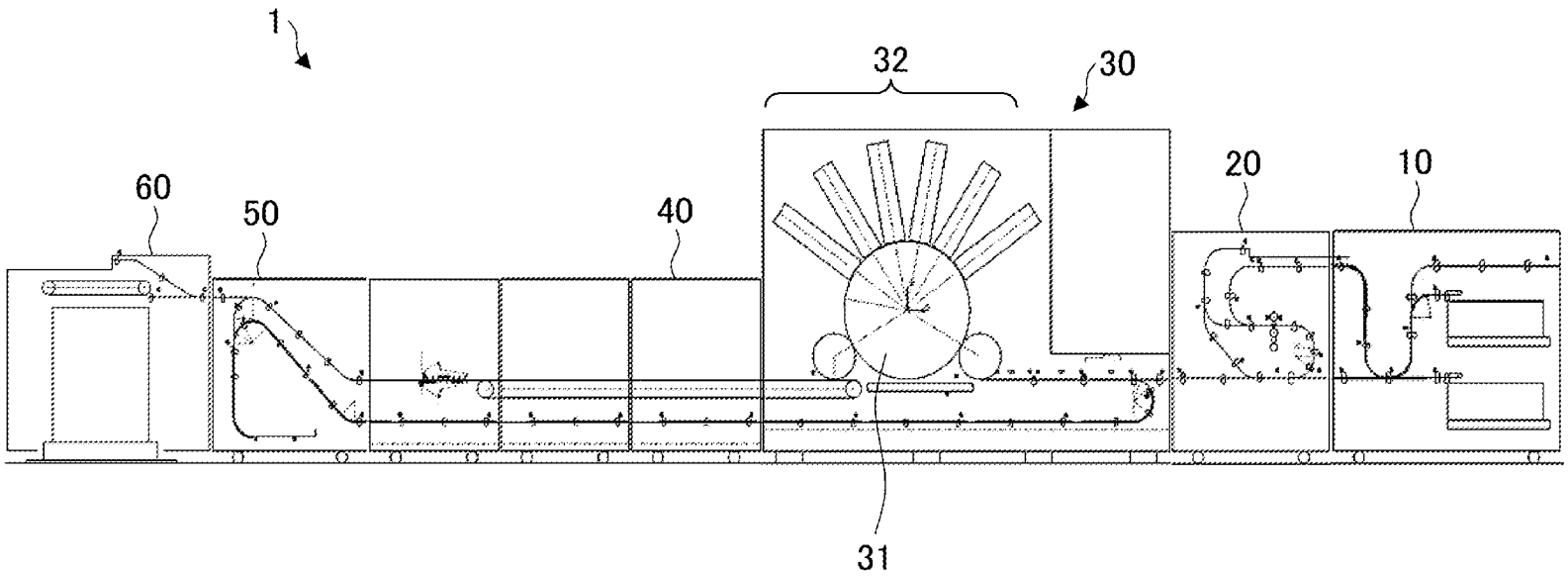
FIG. 1 is a diagram schematically depicting a configuration of an image forming apparatus according to an embodiment of the present application.

In the following, embodiments of the present disclosure will be described in detail with reference to the accompanying drawings. With regard to the drawings, for components having substantially the same or corresponding functional configuration, an overlapping description may be omitted by giving the same reference numerals.

Moreover, the embodiments which will be described below exemplify an image forming apparatus, a liquid discharging apparatus, a control method and a non-transitory recording medium for realizing the technical idea of the present disclosure, and the present disclosure is not limited to the embodiments shown below. Dimensions, materials, shapes, relative layouts, and values of parameters of components which will be described below do not aim at limiting the scope of the present invention only to them, but are intended to exemplify, unless specifically described. Moreover, the size, a positional relationship and the like of the components shown in the drawings, may be partially exaggerated to facilitate understanding of the contents of the present invention.

Among the terms used in the embodiments, an image formation, a recording, a printing of letters, a transfer printing, a printing, and a shaping will be regarded as synonyms. In the embodiment of the present application, the liquid discharging apparatus is provided with a liquid discharging head or a liquid discharging unit, and drives the liquid discharging head to discharge a liquid.

The liquid discharging apparatus may include a unit regarding a feeding, a conveying and an ejecting of a medium, to which a liquid can adhere. In addition, the liquid discharging apparatus may include a preprocessing device, a postprocessing device, or the like. For example, the liquid discharging apparatuses include an image forming apparatus that discharges a liquid such as an ink, to form an image on a sheet of paper.

The medium, to which a liquid can adhere, is a medium to which the liquid can adhere at least temporarily. The media include a medium in which the adhering liquid is fixed, a medium in which the adhering liquid permeates, and the like. For example, the medium is a recording medium. Moreover, the liquid is not particularly limited as long as the liquid has a viscosity and a surface tension so that the liquid can be discharged from the head. The liquid preferably has a viscosity of 30 mPa·s or less at a normal temperature under a normal pressure, or even being heated or cooled. More specifically, the liquids include a solvent such as water or an organic solvent; a colorant such as a pigment or a dye; a functionality imparting material such as a polymerizable compound, a resin, or a surfactant; a biocompatible material such as a DNA, an amino acid, a protein, or a calcium; an edible material such as a natural pigment; or the like. The above-described liquids can be used, for example, as an ink for an ink jet; a surface treatment liquid; a liquid for forming a component such as an electronic element or a light emitting element, or a resist pattern for an electronic circuit; a liquid for a material for three-dimensional shaping; or the like.

Moreover, in some liquid discharging apparatus, the liquid discharging head moves relatively to the medium to which the liquid can adhere. However, the present invention is not limited to this. Specifically, the liquid discharging apparatuses include, for example, a serial type apparatus in which the liquid discharging head moves, a line type apparatus in which the liquid discharging head does not move.

The liquid discharging unit is obtained by integrating the liquid discharging head, with a functional component and a mechanism, and is an assembly of parts related to the discharge of the liquid. For example, the liquid discharging units include a combination of the liquid discharging head and at least one of the following components: a head tank, a carriage, a supply mechanism, a maintenance recovery mechanism, and a main scanning moving mechanism.

The integration includes, for example, fixing the liquid discharging head to the functional component and the mechanism by a fastening, by a bonding, by an engagement, or by the like; and holding them so that the liquid discharging head is movable with respect to the functional component and the mechanism. Moreover, the liquid discharging head may be detachable from the functional component and the mechanism.

For example, the liquid discharging unit may be obtained by integrating the liquid discharging head with the head tank. Moreover, the liquid discharging head and the heat tank may be connected to each other via a tube or the like. With this configuration, a unit including a filter for intervening between the head tank and the liquid discharging head may be added. Moreover, the liquid discharging unit may be obtained by integrating the liquid discharging head and the carriage.

Moreover, the liquid discharging unit may be obtained by integrating the liquid discharging head with a scanning moving mechanism, by holding them so that the liquid discharging head is movable with respect to a guide member constituting a part of the scanning moving mechanism. Moreover, the liquid discharging unit may be obtained by integrating the liquid discharging head, the carriage, and the main scanning moving mechanism.

Moreover, the liquid discharging unit may be obtained by integrating the liquid discharging head, the carriage, and the maintenance recovery mechanism, by fixing a cap member which is a part of the maintenance recovery mechanism to the carriage to which the liquid discharging head is attached.

Moreover, the liquid discharging unit may be obtained by integrating the liquid discharging head with the supply mechanism, by connecting a tube to the liquid discharging head to which the head tank or a flow passage component is attached. A liquid in a liquid storage part is supplied to the liquid discharging head via the tube.

The main scanning moving mechanism includes a guide member alone. Moreover, the supply mechanism also includes a tube alone and a loading part alone.

The liquid discharging head is a functional component for discharging/ejecting a liquid from a nozzle. Energy sources for discharging a liquid include devices using a piezoelectric actuator (a lamination type piezoelectric element and a thin film type piezoelectric element), a thermal actuator using an electrothermal conversion element such as a heating resistor, an electrostatic actuator including a diaphragm and a counter electrode, and the like.

In the following, embodiments of the present application will be described with a sheet material cutout in a prescribed size, as an example of the recording medium, and an ink-jet image forming apparatus of an on-demand line scanning type, as an example of the liquid discharging apparatus.

The sheet materials include specifically regular paper, a coated paper with a surface subjected to a prescribed coating treatment, a film, and the like. Moreover, the liquid is an example of the coloring material.

First Embodiment

Example of a Configuration of an Image Forming Apparatus 1

FIG. 1 is a diagram depicting an example of a configuration of an image forming apparatus 1 according to an embodiment of the present application. As shown in FIG. 1, the image forming apparatus 1 includes a paper feeding unit 10, a pre-applying unit 20, an image forming unit 30, a drying and cooling unit 40, a reversing unit 50, and a paper discharging unit 60. In the image forming apparatus 1, the pre-applying unit 20 applies preliminarily an undercoating liquid to a sheet material, which is a sheet-like member supplied from the paper feeding unit 10. However, depending on a type of the sheet material, without applying the undercoating liquid, the sheet material may be conveyed to the image forming unit 30.

The image forming unit 30 causes the sheet material conveyed from the pre-applying unit 20 to adhere to a conveyance drum 31. The image forming unit 30 forms an image applying a liquid discharged from a liquid discharging part 32 to the sheet material while conveying the sheet material according to a rotation of the conveyance drum 31. The sheet material on which the liquid was applied is sent to the drying and cooling unit 40.

The drying and cooling unit 40 includes a drying mechanism part for drying the liquid applied on the sheet material by the image forming unit 30, and a suction and conveyance mechanism part for conveying the sheet material conveyed from the image forming unit 30 in a sucked state (sucking and conveying).

The sheet material conveyed from the image forming unit 30 is conveyed, after being received by the suction and conveyance mechanism part, so as to pass through the drying mechanism part, and is delivered to the reversing unit 50. When the sheet material passes through the drying mechanism part, the liquid on the sheet material is subjected to a drying treatment. Thus, a solvent such as water in the liquid is evaporated, and a coloring agent contained in the liquid on the sheet material is fixed, and thus an occurrence of a curling of the sheet material is suppressed. Because a temperature of the sheet material might become high depending on the type of the sheet material, the drying and cooling unit 40 may be provided with a cooling mechanism part. The cooling mechanism part cools the sheet material heated in a drying process by the drying mechanism part.

The reversing unit 50 performs a switch-back reversing for the sheet material in order to apply the liquid to a surface of a side (a reverse side) of the sheet material opposite to the side to which the liquid was applied by the image forming unit 30. Then, the sheet material is conveyed to the image forming unit 30 in a state where the reverse side faces a liquid discharging unit 33. The sheet material to which the liquid was applied to the reverse side by the image forming unit 30 is dried and/or cooled by the drying and cooling unit 40, and sent via the reversing unit 50 to the paper discharging unit 60.

The paper discharging unit 60 includes an ejection tray on which a plurality of sheets materials are stacked. The sheet materials conveyed from the reversing unit 50 are stacked sequentially on the ejection tray and retained. In addition, the image forming apparatus 1 may be provided with a binding processing unit for binding a plurality of sheets between the drying and cooling unit 40 and the reversing unit 50.

Example of Configuration of Image Forming Unit 30

Figure 2:
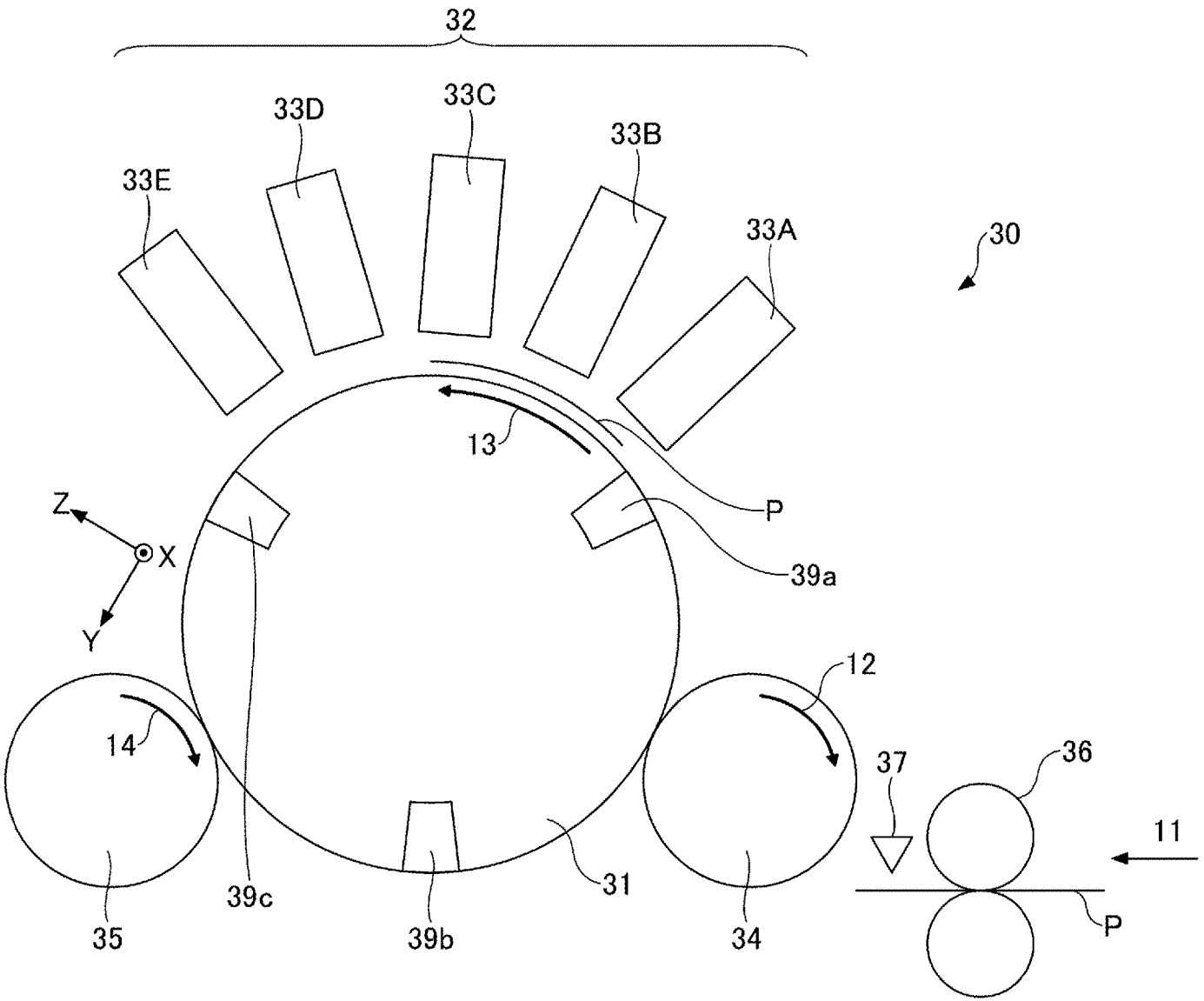
FIG. 2 is a diagram schematically depicting a configuration of an imaging unit according to the embodiment of the present application.

FIG. 2 is a diagram depicting an example of a configuration of the image forming unit 30 according to the embodiment of the present application. An X-direction shown in FIG. 2 represents a direction of axis of the conveyance drum 31, a Y-direction represents a circumferential direction of the conveyance drum 31, and a Z-direction represents a radial direction of the conveyance drum 31.

As shown in FIG. 2, the image forming unit 30 includes the conveyance drum 31 for carrying a sheet material P on an outer peripheral surface and conveying the sheet material P, as an example of a rotating member, and a liquid discharging part 32 for discharging a liquid toward the sheet material P carried by the conveyance drum 31. Moreover, the image forming unit 30 further includes a transfer cylinder 34 for receiving the sheet material P that was put into the image forming unit 30 and transferring the sheet material P to the conveyance drum 31, and a delivering cylinder 35 for delivering the sheet material P conveyed by the conveyance drum 31 to the drying and cooling unit 40.

The conveyance drum 31, the transfer cylinder 34 and the delivering cylinder 35 may be connected via a gear or the like and driven one another.

The sheet material P on which an undercoating liquid was applied by the pre-applying unit 20, and which was sent to the image forming unit 30, proceeds in a conveyance direction 11. Then, a resist roller pair 36 is driven at a predetermined timing adjusted based on a timing that a front end of the sheet material P passes through a sheet material front end detection sensor 37, and an encoder signal detecting a rotational angle of the conveyance drum 31, and thereby the sheet material P is sent to the delivering cylinder 35.

The front end of the sheet material P is held by a sheet gripper (not shown) that is mechanically openable/closable arranged on a surface of the transfer cylinder 34, and the sheet material P is conveyed with a rotation of the transfer cylinder 34 in a direction indicated by an arrow 12. The sheet material P conveyed by the transfer cylinder 34 is delivered to the conveyance drum 31 at a position facing the conveyance drum 31.

A sheet gripper (not shown) is arranged also on a surface of the conveyance drum 31, and the front end of the sheet material P is held by the sheet gripper. A plurality of suction holes are formed dispersedly on a surface of the conveyance drum 31.

A sucked air current directed from the suction holes toward the inside of the conveyance drum 31 is generated by a suction device, which is a suction unit, arranged inside the conveyance drum 31. The front end of the sheet material P delivered from the transfer cylinder 34 to the conveyance drum 31 is held by the sheet gripper and the sheet material P is sucked onto the surface of the conveyance drum 31 by the sucked air current by the suction device. Thus, the sheet material P is conveyed with a rotation of the conveyance drum 31 in a rotational direction 13.

The liquid discharging part 32 is provided with liquid discharging units 33 (33A to 33E). For example, the liquid discharging units 33A, 33B, 33C, and 33D discharge liquids of cyan (C), magenta (M), yellow (Y), and black (K), respectively. Moreover, the liquid discharging unit 33E is used for discharging any of yellow (Y), magenta (M), cyan (C), and black (K), or a special liquid such as white, or gold (silver). Moreover, a discharging unit for discharging a treatment liquid such as a surface coating liquid may be provided.

Figure 3:
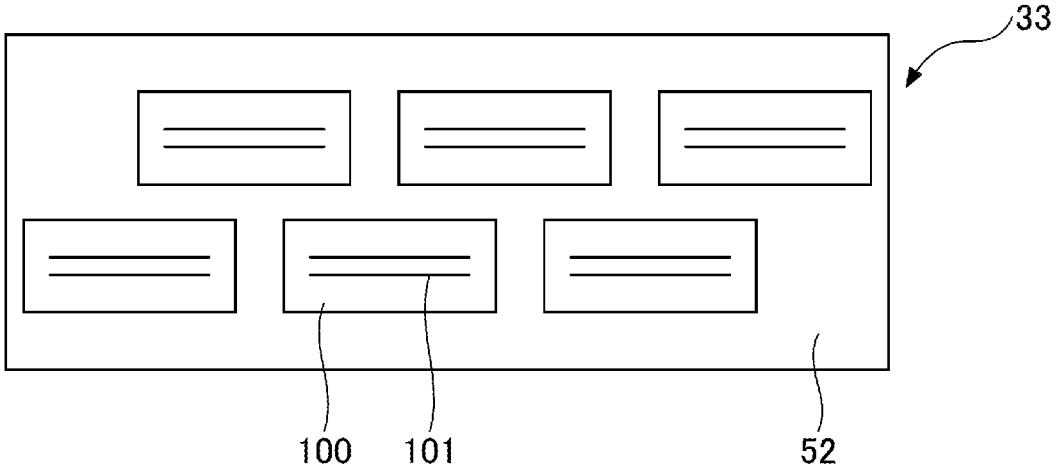
FIG. 3 is a plan view schematically depicting a configuration of a liquid discharging unit according to the embodiment of the present application.

The liquid discharging unit 33 is, for example, a full-line type head, as shown in FIG. 3, in which a plurality of liquid discharging heads (in the following, simply referred to as "heads") 100 each having a nozzle array 101, in which a plurality of nozzles are arranged, are arranged on a base member 52.

A liquid discharging operation of each of the liquid discharging units 33 of the liquid discharging part 32 is controlled by a drive signal according to an image data. When the sheet material P carried by the conveyance drum 31 passes through an opposing area to the liquid discharging part 32, liquids of the respective colors are discharged from the liquid discharging units 33, applied to the sheet material P, and thereby an image according to the image data is formed. The image data are data for forming the image. In the embodiment of the present application, the image data include image data for forming an image on the sheet material P, image data for forming a pattern image in a flushing region, and the like.

The sheet material P to which the liquids are applied is delivered to the delivering cylinder 35, conveyed with a rotation of the delivering cylinder 35, and sent to the drying and cooling unit 40.

Moreover, as shown in FIG. 2, the conveyance drum 31 is provided with sponges 39 (39*a* to 39*c*) at three locations.

The sponges 39 are examples of liquid receiving parts that receive flushed liquids, and arranged between the plurality of sheet materials P conveyed by the conveyance drum 31. The liquid discharging units 33 can flush liquids toward the sponges 39.

The flushing refers to a discharging that does not contribute to the image formation. The term "flushing" may be replaced by other terms, such as an empty discharging, a preliminary discharging, a purge, a dummy jet. Moreover, the liquid receiving part may be referred to as an empty discharge receiving unit. By performing the flushing, a thickened liquid or the like inside the head can be ejected. Thus, the head can be maintained in a normal state without a discharge abnormality such as a discharge failure nozzle. Discharging a liquid for flushing is an example of an "ejection of coloring material".

The sponges 39 absorb the flushed liquids. The liquids are stored in the sponges 39 as waste liquids. When the sponges 39 become a state in which the sponges have received waste liquids sufficiently (a full state), the sponges 39 are replaced by new sponges.

The sponges 39 are inserted into grooves arranged near the surface of the conveyance drum 31 and penetrating through in the X-direction, and attached to the conveyance drum 31. The sponges 39 can be detached from the conveyance drum 31 by pulling the sponges 39 in the X-axis positive direction. The sponges 39 are attached to the conveyance drum 31 by pushing the sponges 39 in the X-axis negative direction. The liquid receiving parts are not limited to the sponges 39, and may be members such as liquid vessels.

Figure 4:
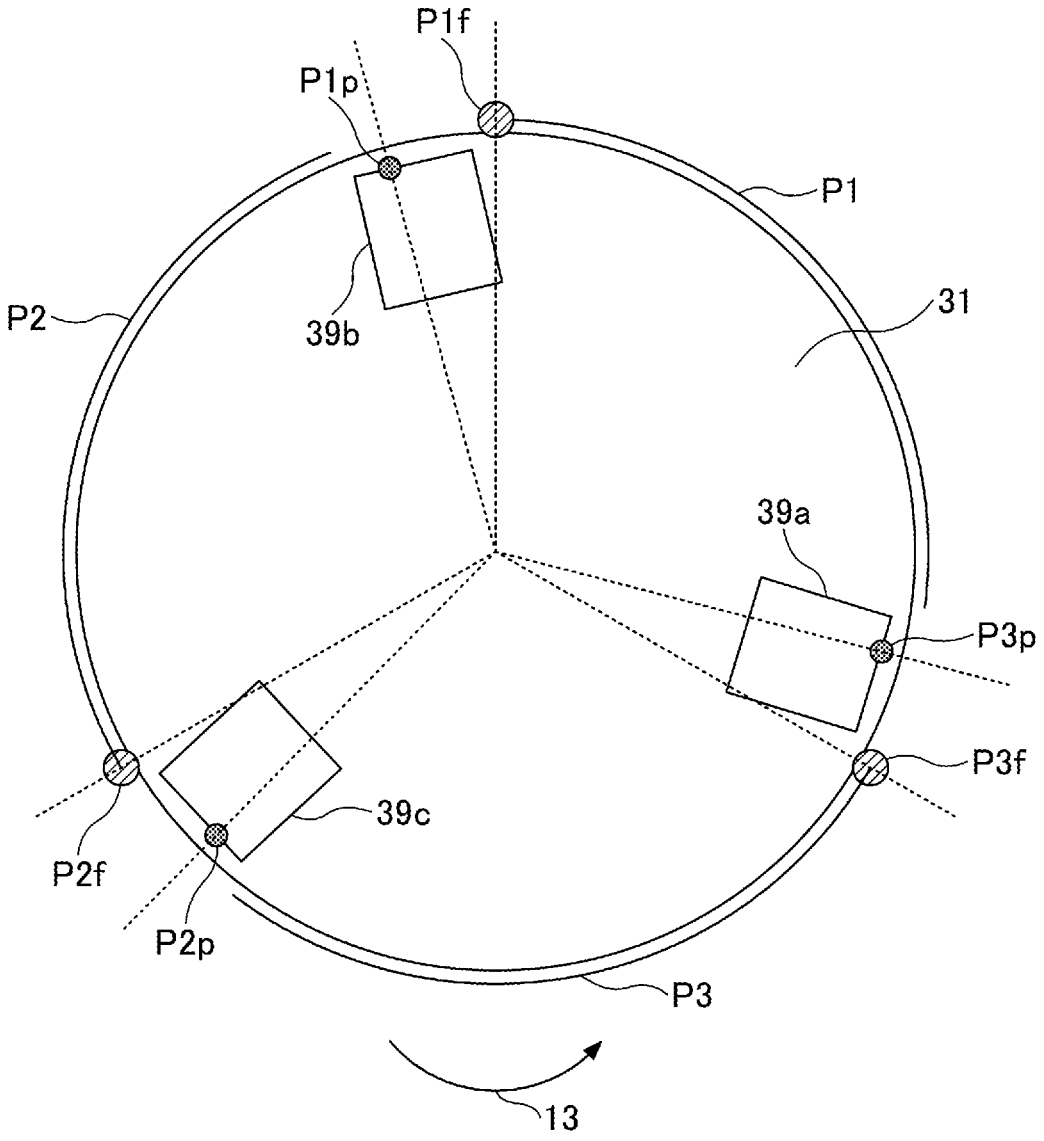
FIG. 4 is a diagram for explaining an example of arranging sponges according to the embodiment of the present application.

FIG. 4 is a diagram explaining in detail an example of the arrangement of the sponges 39 on the conveyance drum 31. As shown in FIG. 4, three sheets materials P1, P2 and P3 adhere to the outer peripheral surface of the conveyance drum 31, and are conveyed with the rotation of the conveyance drum 31 in the rotational direction 13. As shown in FIG. 4, the sponges 39*a*, 39*b* and 39*c* are arranged between the sheet materials P1, P2 and P3.

A front end P1*f* is a front end of the sheet material P1 in the rotational direction 13, a front end P2*f* is a front end of the sheet material P2 in the rotational direction 13, and a front end P3*f* is a front end of the sheet material P3 in the rotational direction 13.

Discharge starting positions P1*p*, P2*p* and P3*p* indicate positions at which each of the liquid discharging units 33 (See FIG. 3) start discharging liquids.

Because the positions at which the sponges 39 are arranged on the conveyance drum 31 have been defined in advance, the flushing can be performed to the sponges 39 in response to output signals from a rotary encoder and a linear encoder arranged in the conveyance drum 31.

Moreover, in the embodiment of the present application, the flushing can be performed not only to the sponges 39, but also to a region that becomes a margin where an image indicated by image data is not formed when an image on a sheet material P based on the image data is formed (referred to as a margin region). In other words, in the embodiment of the present application, by forming a pattern image in the sponges 39, the margin region, or both, it is possible to eject a thickened liquid or the like inside the head, to perform the flushing.

However, when a sufficient flushing effect can be obtained only by the flushing to the margin region, the flushing to the liquid receiving part may not be performed. In the case of performing the flushing to the liquid receiving part, when the liquid receiving part becomes a full state, the liquid receiving part needs to be replaced. On the other hand, in the case of performing the flushing only to the margin region, a labor and a cost for replacing the liquid receiving part can be reduced. Thus, the flushing to the margin region is preferably given priority over the flushing to the liquid receiving part. In the case of not performing the flushing to the liquid receiving part, the liquid receiving part may not be provided.

Example of a Hardware Configuration of the Image Forming Apparatus 1

Figure 5:
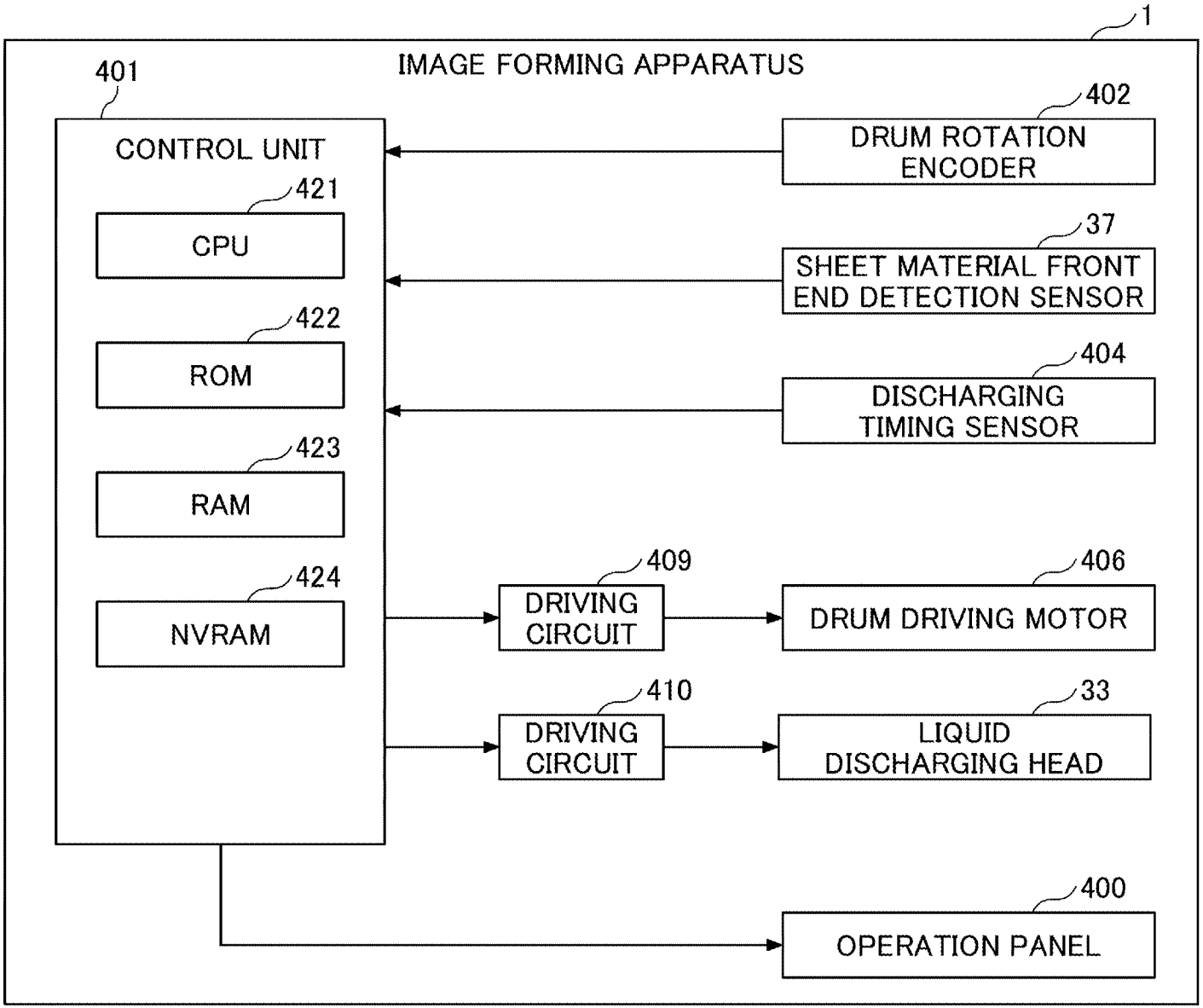
FIG. 5 is a block diagram depicting the configuration of the image forming apparatus according to the embodiment of the present application.

Next, a hardware configuration of the image forming apparatus 1 will be described. FIG. 5 is a block diagram depicting an example of the hardware configuration of the image forming apparatus 1 according to the embodiment of the present application.

As shown in FIG. 5, the image forming apparatus 1 includes a control unit 401, a drum rotation encoder 402, a sheet material front end detection sensor 37, a discharging timing sensor 404, a drum driving motor 406, a liquid discharging unit 33, driving circuits 409 and 410, and an operation panel 400.

Moreover, the control unit 401 includes a central processing unit (CPU) 421, a read only memory (ROM) 422, a random access memory (RAM) 423, and a non-volatile random access memory (NVRAM) 424.

Among the above-described members, the CPU 421 controls an entire operation of the image forming apparatus 1. The ROM 422 stores a program or the like used for activating the CPU 421 such as an IPL (initial program loader). The RAM 423 is used as a work area for the CPU 421. The NVRAM 424 stores a program and various data, and maintains the various data even when the power of the image forming apparatus 1 is OFF.

The drum rotation encoder 402 detects a rotational speed, a rotational angle, or a rotational position of the conveyance drum 31. The drum rotation encoder 402 includes a rotary encoder 301 and/or a linear encoder 311. The drum rotation encoders 402 are preferably arranged at a plurality of positions of the conveyance drum 31 in order to remove an eccentricity and an irregularity of the conveyance drum 31.

In order to detect a reference position of the rotation of the conveyance drum 31, the drum rotation encoder 402 preferably outputs a Z-phase signal in addition to an A-phase/B-phase signal. However, a sensor different from the drum rotation encoder 402, such as a home position sensor, may be provided.

The sheet material front end detection sensor 37 detects a front end of the sheet material P, as described above. As the sheet material front end detection sensor 37, a reflection-type optical sensor or the like may be used.

The discharging timing sensor 404 is used for generating a discharging timing of the liquid discharging units 33 of respective colors.

Based on the timing of detecting the sheet material P by the discharging timing sensor 404, i.e. based on the timing at which the sheet material P passes through a position where the discharging timing sensor 404 is arranged, the respective liquid discharging units 33 perform the discharging based on an output pulse from the drum rotation encoder 402.

The discharging may be performed based on the detection timing by the sheet material front end detection sensor 37 without using the discharging timing sensor 404. In order to suppress a detection error of the drum rotation encoder 402, the discharging timing sensor 404 is preferably arranged near the liquid discharging units 33 so as to be located within a distance that the liquid discharging units 33 can respond to the signal from the discharging timing sensor 404.

The drum driving motor 406 is an AC servo motor or the like for rotatably driving the conveyance drum 31. The control unit 401 outputs a control signal to the driving circuit 409 based on an output pulse form the drum rotation encoder 402. The drum driving motor 406 rotates the conveyance drum 31 in response to a driving signal from the driving circuit 409.

The liquid discharging units 33 discharge liquids at the timing determined based on the output from the discharging timing sensor 404, in response to the driving signal from the driving circuit 410 for driving the liquid discharging units 33. The control unit 401 determines a drive waveform based on image data, and output a signal in response to the drive waveform to the driving circuit 410.

The operation panel 400 includes a touch panel in which current setting values, a selection screen, various messages from the image forming apparatus 1, or the like are displayed, and which accepts an input from an operator of the image forming apparatus 1; an alarm lamp; and the like.

Example of a Function Configuration of the Control Unit 401

Figure 6:
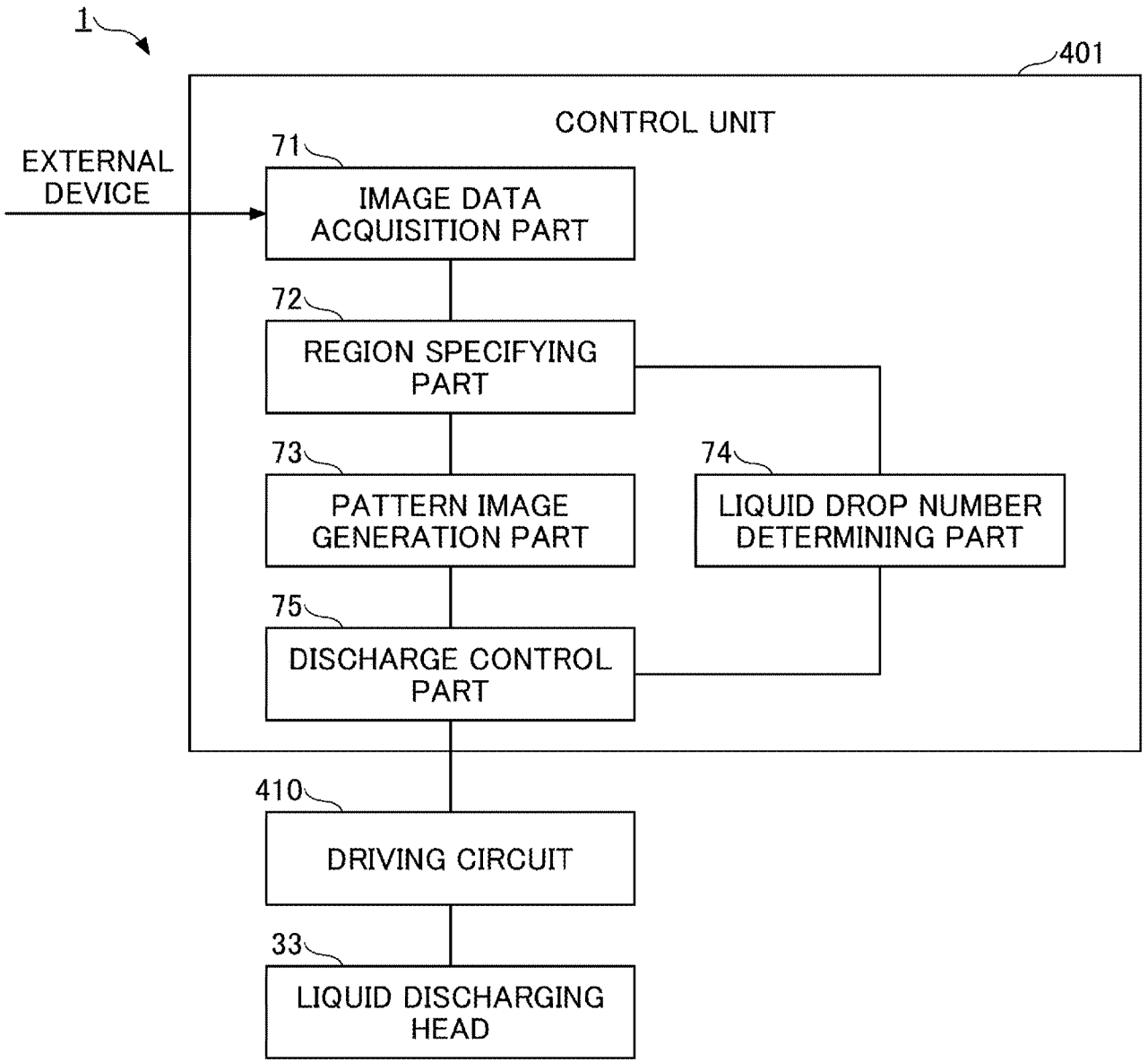
FIG. 6 is a block diagram depicting a configuration of functions of a control unit according to the embodiment of the present application.

Next, FIG. 6 is a block diagram depicting an example of a function configuration of the control unit 401 included in the image forming apparatus 1. As shown in FIG. 6, the control unit 401 includes an image data acquisition part 71, a region specifying part 72, a pattern image generation part 73, a liquid drop number determining part 74, and a discharge control part 75.

The image data acquisition part 71 acquires image data of a print image to be formed on the sheet material P from an external device such as a personal computer (PC), and outputs the acquired image data to the region specifying part 72.

The region specifying part 72 specifies a margin region that becomes a margin when the image forming apparatus 1 forms an image on the sheet material P based on the image data acquired by the image data acquisition part 71. For example, by the region specifying part 72, a front end side margin region located on the front end side of the sheet material P in the conveyance direction, and a rear end side margin region located on the rear end side are specified to be the margin regions.

Moreover, the region specifying part 72 can also specify a region in which the pattern image is formed by the liquids discharged for the flushing (referred to as a flushing region) within the margin region specified as above. For example, a front end side flushing region located on the front end side of the sheet material P in the conveyance direction, a rear end side flushing region located on the rear end side, and the like are specified to be the flushing regions.

The region specifying part 72 can specify the margin region and the flushing region based on information, such as an image formation condition (printing condition) or a margin setting condition, in addition to the image data. The region specifying part 72 outputs information on the specified margin region to the pattern image generation part 73, and the liquid drop number determining part 74.

The pattern image generation part 73 generates image data of the pattern image to be formed in the margin region based on a size of the margin region specified by the region specifying part 72 and a type of the liquid. For example, the pattern image generation part 73 can determine a size of a pattern in the pattern image for each type of the liquid. The flushing is performed by forming the pattern image in one of the sponges 39, the margin region, or both.

The type of the liquid is information indicating a composition of the liquid. Because the composition of the liquid differs according to the color of the liquid, in the embodiment of the present application, the color of the liquid will be handled as an example of the type of the liquid. However, the type of the liquid is not limited to the color of the liquid, and differs according also to the physical property of the liquid. Thus, the types of the liquids having the same color may be different.

Moreover, the pattern images include an image of a stripe pattern, an image of a pattern having a shape of a cross-stitch, and the like. The stripe pattern includes periodically formed lines. By changing a thickness of the lines or a cycle of a formation of the lines, a cycle of discharging a liquid or an amount of the discharged liquid when the pattern image is formed can be changed. The cross-stitch pattern includes characters (symbols) of "X" that are periodically formed. By changing a thickness of lines of the character "X" or a cycle of a formation of the characters, a liquid can be discharged with the cycle or the amount different from those for the stripe pattern. The pattern image is not limited to the stripe pattern or the cross-stitch pattern, and a preferable pattern image may be appropriately generated according to a desired cycle of discharging liquid or a desired amount of the discharged liquid.

The liquid drop number determining part 74 determines a number of liquid drops of the discharged liquid based on a size of the margin region and the type of the liquid. The liquid drop is defined in the specification as a particle of the liquid formed immediately after the liquid is discharged from a nozzle of the head 100. In the formation of an image, liquid drops of the discharged liquid are impacted on the sheet material P, then the discharged liquid adheres to the sheet material P, and the image is formed.

For an initial value of the liquid drop number, a liquid drop number for the flushing in the case where the flushing is not performed on the sheet material P and the flushing is performed only on the sponges 39 (preliminary discharge receiver) is set in advance. When the flushing to the sheet material P is to be performed, the flushing to the sheet material P is performed in preference to the preliminary discharge receiver.

When the flushing is performed on the sheet material P, the liquid drop number determining part 74 can determine the number of liquid drops for the flushing to the sheet material P based on a size of the generated pattern image and a type of the pattern. Because a density of the pattern in the pattern image can be determined by determining the liquid drop number, the liquid drop number determining part 74 corresponds to an example of a density determining unit.

Among parameters of the pattern image, which will be described later, any of a continuous discharging frequency or a frequency of repetitions in a continuous discharging is a fixed value. A value of the unfixed parameter of the two is obtained by the fixed parameter value and the size of the pattern image.

The discharge control part 75 controls an operation of discharging a liquid in the liquid discharging unit 33 based on information on the image data of the pattern image generated by the pattern image generation part 73 and a number of liquid drops determined by the liquid drop number determining part 74.

Example of a Process by the Control Unit 401

Figure 7:
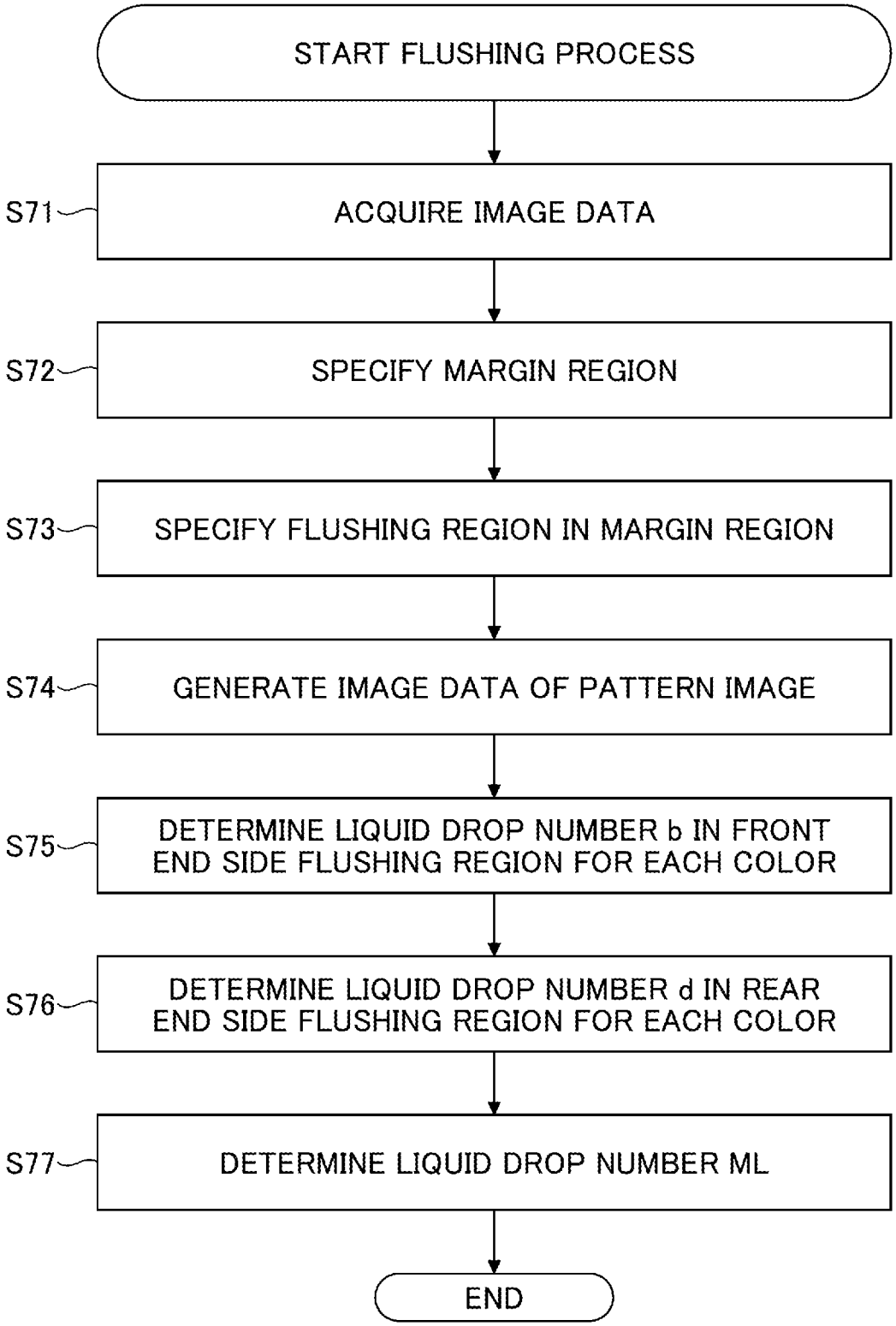
FIG. 7 is a flowchart depicting an example of a processing by the control unit according to the embodiment of the present application.

Next, a processing by the control unit 401 will be described. FIG. 7 is a flowchart depicting an example of the processing by the control unit 401. FIG. 7 shows a processing for generating image data of the pattern image, and a processing for determining a number for liquid drops for performing the flushing to both the margin region and the liquid receiving part. The liquid drop number here refers to a number of liquid drops discharged from one nozzle in the head 100 (See FIG. 3).

Moreover, the processing shown in FIG. 7 is performed each time the flushing is performed. The flushing may be performed during the image formation on the sheet material P, or before starting the image formation on the sheet material P. The timing of performing the flushing may be appropriately selected according to the thickening property of the liquid or the like.

In the embodiment of the present application, as an initial value of the number of liquid drops to be discharged for performing the flushing, a liquid drop number M in the case of performing the flushing only on the sponges 39 is set in advance.

In step S71, the image data acquisition part 71 acquires image data from an external device such as a PC, and outputs the acquired image data to the region specifying part 72 and the liquid drop number determining part 74.

Then, in step S72, the region specifying part 72 specifies a margin region based on the image data acquired by the image data acquisition part 71.

Next, in step S73, the pattern image generation part 73 specifies a front end side flushing region and a rear end side flushing region as flushing regions in the margin region.

In step S74, the pattern image generation part 73 generates image data of a pattern image to be formed in the margin region based on a size of the margin region specified by the region specifying part 72 and a type of a liquid.

In step S75, the liquid drop number determining part 74 determines a number of liquid drops b for performing the flushing to a front end side flushing region in the margin region of the sheet material P in a conveyance direction for each color of the liquid based on a size of the front end side flushing region.

In step S76, the liquid drop number determining part 74 determines a number of liquid drops d for performing the flushing to a rear end side flushing region in the margin region of the sheet material P in a conveyance direction for each floor of the liquid based on a size of the rear end side flushing region.

In step S77, according to the liquid drop number for performing the flushing to the margin region, a number of liquid drops ML for performing the flushing to the liquid receiving part is determined. At this time, by dividing the region for performing the flushing into the margin region and the liquid receiving part, the number of liquid drops may become insufficient. The insufficient number of liquid drops will be supplemented by a division-based additional liquid drop V. As a result, the number of liquid drops ML for performing the flushing to the liquid receiving part is determined by the relation:

$$ML=M-b-d+V.$$

Thus, the control unit 401 can generate image data for the pattern image, and determine liquid drop numbers for performing the flushing to the margin region and the liquid receiving part. In the case of performing the flushing only in the margin region, only the liquid drop numbers b and d may be determined.

Example of Result of Specifying the Margin Region and the Flushing Region

Figure 8:
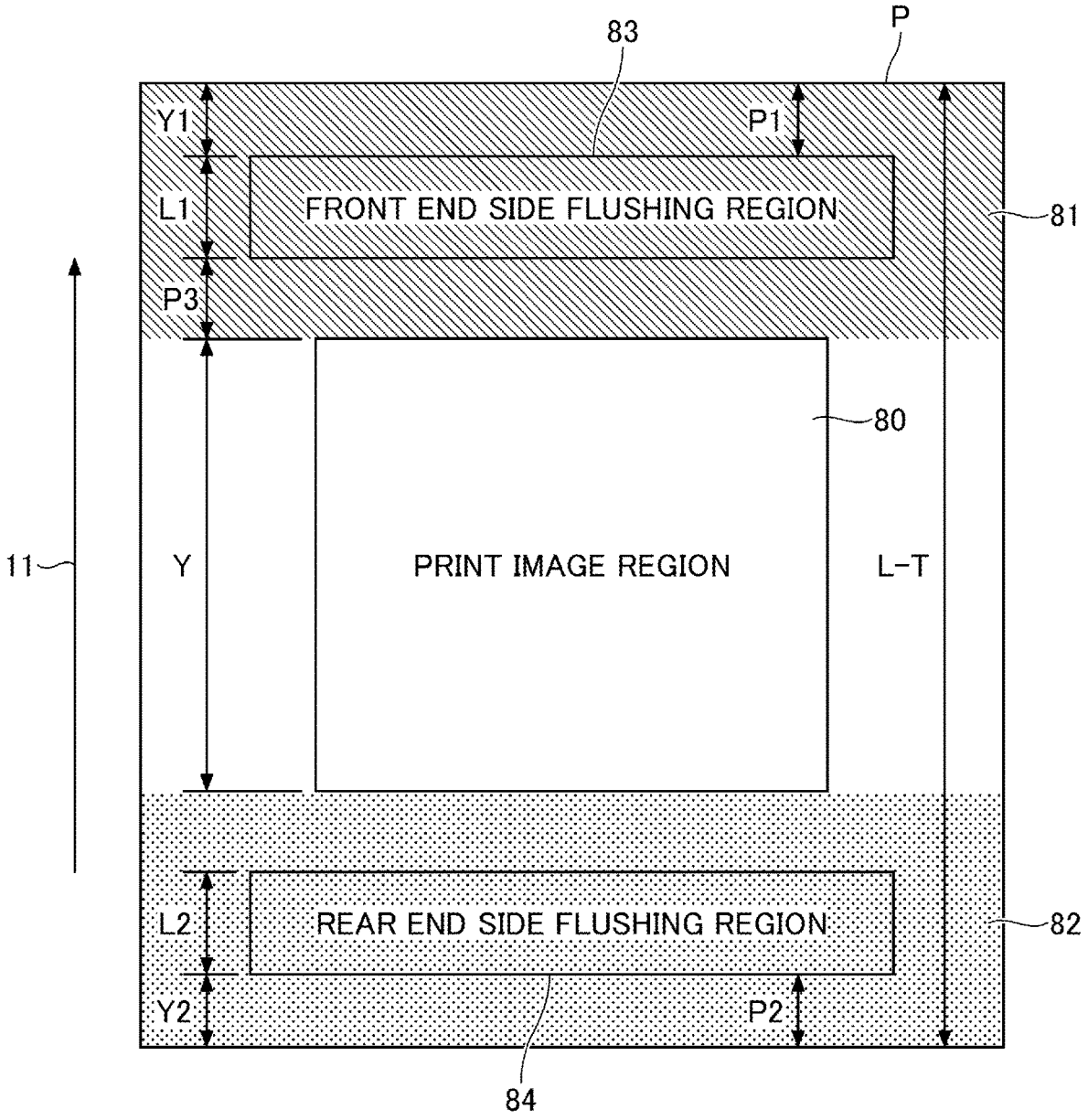
FIG. 8 is a diagram depicting an example of a result of a specification process for a margin region and a flushing region.

Next, results of specifying the margin region and the flushing region by the region specifying part 72 will be described. FIG. 8 is a diagram for explaining an example of results of specifying the margin region and the flushing region. FIG. 8 shows the margin region and the flushing region arranged on the sheet material P.

As shown in FIG. 8, a print image region 80, in which a print image obtained by the image formation is formed, is arranged at the center of the sheet material P. A front end side margin region 81 (hatched part by oblique lines) is specified on a downstream side of the print image region 80 in the conveyance direction 11. A rear end side margin region 82 (hatched part by satin pattern) is specified on an upstream side of the print image region 80 in the conveyance direction 11. Moreover, a front end side flushing region 83 is specified within the front end side margin region 81, and a rear end side flushing region 84 is specified within the rear end side margin region 82. The front end side margin region 81 and the rear end side margin region 82 are examples of the margin region.

Meanings of the respective parameters shown in FIG. 8 will be listed as follows:

L represents an ideal length of the sheet material P in the conveyance direction 11;

Y represents a length of the print image region 80 in the conveyance direction 11;

T is a variable in which a tolerance of the length of the sheet material P is set;

P1 is a variable in which an amount of a mask on the front end side of the sheet material P is set;

P2 is a variable in which an amount of a mask on the rear end side of the sheet material P is set;

P3 represents a distance between the front end side flushing region 83 and the print image region 80 in the conveyance direction 11;

Y1 represents a position of an end of the front end side flushing region 83 in the conveyance direction 11;

Y2 represents a position of an end of the rear end side flushing region 84 in the conveyance direction 11;

L1 represents a length of the front end side flushing region 83 in the conveyance direction 11; and L2 represents a length of the rear end side flushing region 84 in the conveyance direction 11.

As a specific example, the position Y1 of the end of the front end side flushing region 83 is specified within a range of 0 mm or more to 100 mm or less, and the length L1 of the front end side flushing region 83 is specified within a range of 0 mm or more to 100 mm or less, where a sum of Y1 and L1 is less than 100 mm. Similarly, the position Y2 of the end of the rear end side flushing region 84 is specified within a range of 0 mm or more to 100 mm or less, and the length L2 of the rear end side flushing region 84 is specified within a range of 0 mm to 100 mm or less, where a sum of Y2 and L2 is less than 100 mm. Moreover, it is possible to set whether to perform the flushing to the margin region by using a parameter.

In FIG. 8, although the variable P1 and the position Y1 of the end indicate the same length, the value of the position Y1 of the end may be greater than the value of the variable P1. For example, when the amount of the liquid for the flushing may be very small, i.e. the flushing is performed within a region that is narrower than the region defined by the rear end of the mask P1 (end of the upstream side in the conveyance direction 11) and the front end of the interval P3 (end of the downstream side in the conveyance direction 11), the value of the position Y1 of the end is greater than the value of the variable P1.

Example of Result of Determination of the Flushing Region for Each Color

Figure 9:
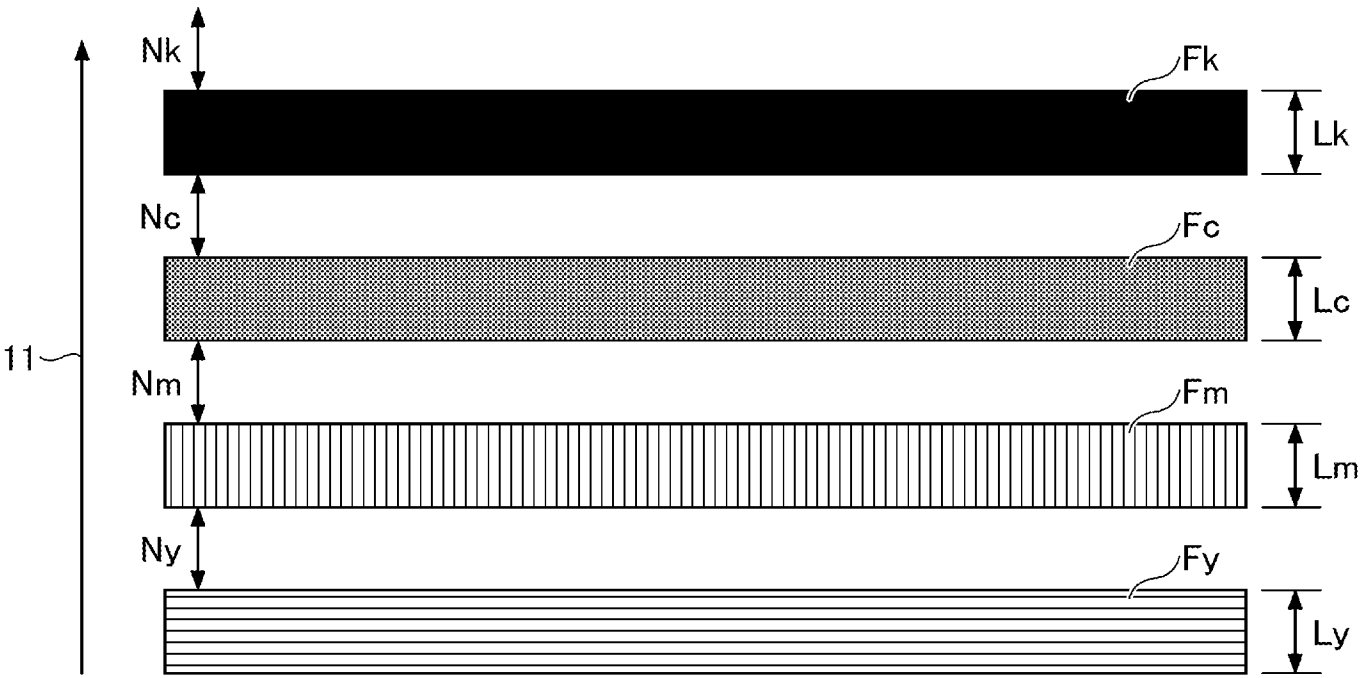
FIG. 9 is a diagram depicting an example of a result of a determination process for the flushing region for each color.

Next, a result of a determination of the flushing regions for respective colors by the pattern image generation part 73 (See FIG. 6) will be described. FIG. 9 is a diagram for explaining an example of the result of the determination of the flushing regions for the respective colors.

As shown in FIG. 9, from the downstream side to the upstream side in the conveyance direction 11, a black flushing region Fk, a cyan flushing region Fc, a magenta flushing region Fm, and a yellow flushing region Fy are determined, individually.

An interval Nk is a distance between the position of the end of the front end side flushing region 83 and the black flushing region Fk in the D conveyance direction 11. An interval Nc is a distance between the black flushing region Fk and the cyan flushing region Fc in the conveyance direction 11.

An interval Nm is a distance between the cyan flushing region Fc and the magenta flushing region Fm in the conveyance direction 11. An interval Ny is a distance between the magenta flushing region Fm and the yellow flushing region Fy in the conveyance direction 11.

A length Lk is a length of the black flushing region Fk in the conveyance direction 11. A length Lc is a length of the cyan flushing region Fc in the conveyance direction 11. A length Lm is a length of the magenta flushing region Fm in the conveyance direction 11. A length Ly is a length of the yellow flushing region Fy in the conveyance direction 11.

By determining the length Lk, Lc, Lm and Ly in the conveyance direction 11, color ratios (ratios for the respective colors) Ck, Cc, Cm, and Cy of amounts of liquids discharged for the flushing can be determined.

In the example shown in FIG. 9, the color ratios are Ck:Cc:Cm:Cy=0.3:0.2:0.25:0.25, which show that the amount of the liquid of black is the greatest, the amount of the liquid of cyan is the smallest, and the amounts of the liquids of magenta and yellow are the same.

However, the lengths of the flushing regions may not be determined according to the amounts of the liquids discharged for the flushing. For example, a density of the pattern of the pattern image may be determined according to the amounts. That is, when a great amount of liquid needs to be discharged, a dense pattern image may be formed, and when a small amount of liquid is to be discharged, a coarse pattern image may be formed.

Specifically, when a drying property on the sheet material P varies greatly due to the color, for a color that is easily dried, a dense pattern image is formed so that a great amount of liquid is discharged, for a color that is not easily dried, a coarse pattern image is formed so that a small amount of liquid is discharged, and thereby the effect of the flushing is preferably obtained.

Moreover, the pattern images of the respective colors may overlap each other, due to the spreading of the liquid in the sheet material P. When the sheet material P is not sufficiently dried in the overlapped portion, the image quality may be deteriorated or a stain of the sheet material P may occur. Thus, the least intervals between the flushing regions for the respective colors in the conveyance direction 11 are preferably determined within a range so that the pattern images for the respective colors do not overlap with each other. The values of the parameters can be appropriately changed according to the type of the sheet material P, an image formation mode for determining the image quality or the like, the drying condition for the liquid after the image formation, or the like.

The region specifying part 72 (See FIG. 6) determines the length L1 of the front end side flushing region 83 (See FIG. 8). Then, the lengths Lk, Lc, Lm, and Ly of the flushing regions for the respective colors in the front end side flushing region 83 are obtained according to the following relations:

$$Lk=\{L1-(Nk+Nc+Nm+Ny)\}\times Ck;$$

$$Lc=\{L1-(Nk+Nc+Nm+Ny)\}\times Cc;$$

$$Lm=\{L1-(Nk+Nc+Nm+Ny)\}\times Cm; \text{ and}$$

$$Ly=\{L1-(Nk+Nc+Nm+Ny)\}\times Cy.$$

For example, the length Lk of the front end side flushing region of black in the conveyance direction 11 of the sheet material P is obtained by the following relation:

$$Lk=\{L1-(Nk+Nc+Nm+Ny)\}\times 0.3.$$

As described above, according to the specified margin region and the flushing region, the lengths of the flushing regions for the respective colors in the conveyance direction 11 can be changed. The lengths Lk, Lc, Lm and Ly correspond to examples of the sizes of the patterns for the types of the liquids in the pattern images.

Example of Image Data of the Pattern Images

Figure 10:
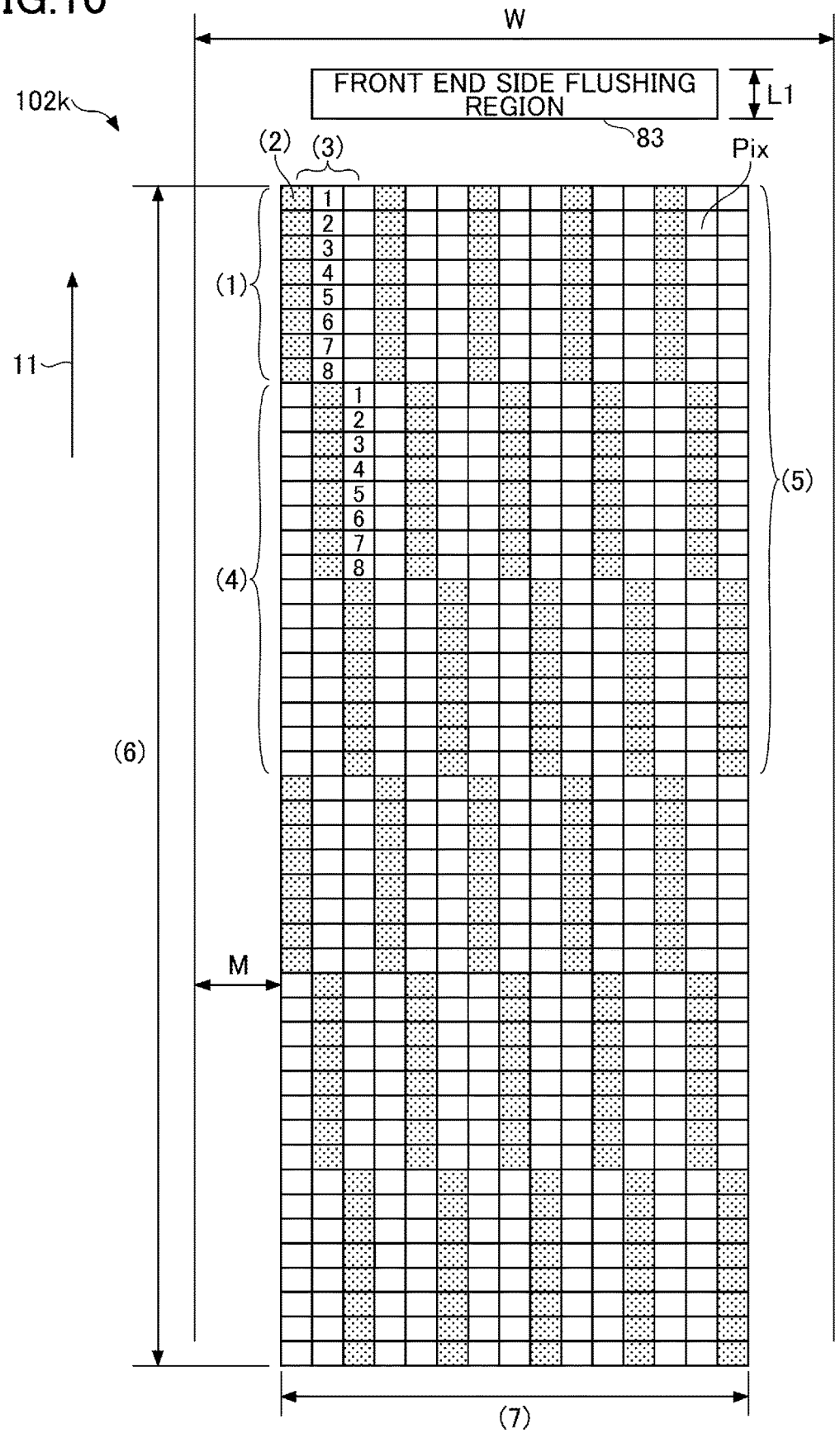
FIG. 10 is a diagram depicting an example of image data of a pattern image.

Next, the image data of the pattern images generated by the pattern image generation part 73 (See FIG. 6) will be described. FIG. 10 is a diagram depicting an example of the image data of the pattern image. The image data of pattern image 102*k* having a stripe pattern including lines each consisting of a plurality of pixels Pix. In the example shown in FIG. 10, the stripe pattern includes black lines extending in the conveyance direction 11 so that one pixel among three pixels is black in the width direction orthogonal to the conveyance direction 11.

Reference numerals (1) to (10) shown in FIG. 10 represent parameters which are determined when the pattern image generation Fe generates the image data of pattern image 102*k*. Moreover, W represents a width of the sheet material P, and M represents a distance from an edge of the sheet material P in the width direction orthogonal to the conveyance direction 11.

The meaning of the parameters will be listed in TABLE 1.

TABLE 1

| No . | Meaning |
|---|---|
| (1) | Continuous discharging frequency in the conveyance direction |
| (2) | Number of shifts of the discharging starting point |
| (3) | Frequency of the shifts of the discharging starting point |
| (4) | Interval between the continuous discharging in the conveyance direction |
| (5) | Frequency of repetitions in the continuous discharging in the conveyance direction |
| (6) | Length of the flushing region in the conveyance direction |
| (7) | Length of the flushing region in the width direction |
| (8) | Switching between a calculation value and a fixed value for (1) and (5) |

TABLE 1-continued

| No . | Meaning |
|---|---|
| (9) | Interval between the colors |
| (10) | Color ratio of the liquid drop numbers |

Among the parameters shown in FIG. 10 and TABLE 1, any one of (1) the continuous discharging frequency in the conveyance direction and (5) the frequency of repetitions in the continuous discharging in the conveyance direction is a calculated value obtained by calculation, and the other is a predetermined fixed value. Parameters of (2) the number of shifts of the discharging starting point, (3) the frequency of the shifts of the discharging starting point, (4) the interval between the continuous discharging in the conveyance direction, (6) the length of the flushing region in the conveyance direction, and (7) the length of the flushing region in the width direction are fixed vales. Moreover, parameters of (8) the switching between a calculation value and a fixed value for (1) and (5), (9) the interval between the colors, and (10) the color ratio of the liquid drop numbers are also fixed values. In the following, for the sake of simplicity, the respective parameters listed in TABLE 1 will be denoted only by the numbers (1) to (10).

The calculated value of the above-described parameter (1) or (5) is obtained by using the length L1 of the front end side flushing region 83 in the conveyance direction 11 and the length L2 of the rear end side flushing region 84 in the conveyance direction 11 (See FIG. 8). For example, when the parameter (1) is a calculated value, the parameter (1) for black is calculated by the formula:

$$(1)=\{L1-(Nk+Nc+Nm+Ny)\}\times Ck/\{(5)\times(1+(4))\}.$$

The value of the parameter (1) corresponds to a liquid drop number. The above-described result of calculation is a number of lines of the pixel lines arranged in the width direction, and a fractional part of the value is truncated.

Moreover, in the front end side flushing region 83, when the parameter (1) is a fixed value and the parameter (5) is calculated based on the length L1, the parameter (5) for black is calculated by the formula:

$$(5)=\{L1-(Nk+Nc+Nm+Ny)\}\times Ck/\{(1)\times(1+(4))\}.$$

The value of the parameter (5) corresponds to a liquid drop number. The above-described result of calculation is also a number of lines of the pixel lines arranged in the width direction, and a fractional part of the value is truncated.

The switching between the parameters (1) and (5) for the calculated value is setting the value of the parameter (8), i.e. when the parameter (1) is a calculated value, the value "0" is set to the parameter (8). When the parameter (5) is a calculated value, the value "1" is set to the parameter (8). The parameter (9) corresponds to the intervals Nk, Nc, Nm, and Ny (See FIG. 9), and the parameter (10) corresponds to the color ratios of the liquid amount Ck, Cc, Cm, and Cy (See FIG. 9).

The pattern image generation part 73 (See FIG. 6) obtains a calculated value of any one of the parameters (1) and (5) based on the length L1 and L2 of the flushing region. Then, by using the values of the parameters listed in TABLE 1, the image data of pattern image 102*k* are generated.

According to the embodiment of the present application, since the image data of pattern image 102*k* are generated by using the respective values of the parameters, image data themselves of various pattern images do not need to be stored in a storage device. Thus, the image forming apparatus 1 is not necessary to be provided with a storage device with a memory capacity sufficient for storing image data of pattern images. In the image forming apparatus 1, a pattern image is formed in the margin region or the liquid receiving part so that the flushing is performed.

In the above-described example with reference to FIG. 10, the image data of pattern image 102*k* for black were shown as an example. However, the present invention is not limited to this, and image data of the pattern image for the other colors can be generated.

Figure 11:
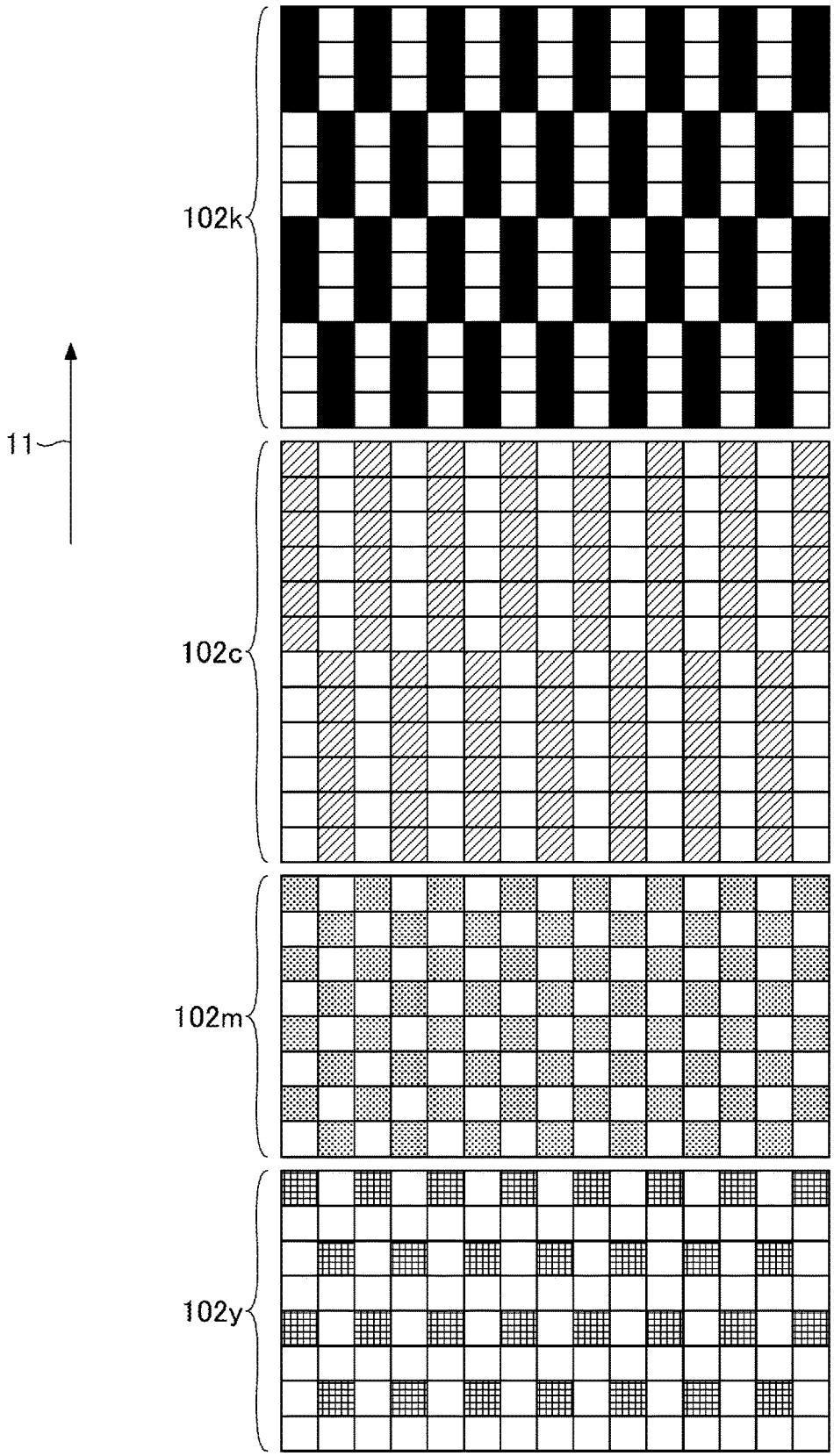
FIG. 11 is a diagram depicting an example of the image data of the pattern image for each liquid.

Next, FIG. 11 is a diagram depicting an example of the image data of the pattern images generated for the respective liquids of four colors. FIG. 11 shows, from the downstream side in the conveyance direction 11 to the upstream side, the image data of pattern image 102*k* for black, the image data of pattern image 102*c* for cyan, the image data of pattern image 102*m* for magenta, and the image data of pattern image 102*y* for yellow.

The image data of pattern images 102*k* and 102*c* have stripe patterns, and the image data of pattern images 102*m* and 102*y* have cross-stitch patterns.

Values of the parameters for the respective colors are shown in TABLE 2.

TABLE 2

| No. | Meaning | K | C | M | Y |
|---|---|---|---|---|---|
| (1) | Continuous discharging frequency in the conveyance direction | 8 | 5 | 1 | 1 |
| (2) | Number of shifts of the discharging starting point | 1 | 1 | 1 | 2 |
| (3) | Frequency of the shifts of the discharging starting point | 1 | 1 | 1 | 1 |
| (4) | Interval between the continuous discharging in the conveyance direction | 1 | 1 | 1 | 1 |
| (5) | Frequency of repetitions in the continuous discharging in the conveyance direction | 1 | 1 | 1 | 7 |
| (6) | Length of the flushing region in the conveyance direction | 16 | 10 | 14 | 14 |
| (7) | Length of the flushing region in the width direction | — | — | — | — |
| (8) | Switching between a calculation value and a fixed value for (1) and (5) | 0 | 0 | 1 | 1 |
| (9) | Interval between the colors | 1 | 1 | 1 | 1 |
| (10) | Color ratio of the liquid drop numbers | 0.3 | 0.2 | 0.25 | 0.25 |
| | Number of liquid drops | 8 | 5 | 7 | 7 |

For the image data of pattern image 102*k*, the value of the parameter (1) is calculated by the following formula and the number of liquid drops is determined:

$$(1)=\{L1-(Nk+Nc+Nm+Ny)\}\times Ck/\{(5)\times(1+(4))\}$$

$$=\{60-(1+1+1+1)\}\times 0.3/\{1\times(1+1)\}$$

$$=8.$$

Thus, the liquid drop number is determined to be 8. In this example, liquids are discharged continuously with a resolution of 1200 dpi (dots per inch) and the highest driving frequency (e.g. 60 kHz). Thus, by securing a stability of the discharging with a liquid drop volume of 5 pl and a high discharging speed of liquid drops, an ejecting performance of the thickened ink can be enhanced. Moreover, patterns are not formed adjacent to each other in the width direction, and thus a drying property of the liquid on the sheet material P is excellent. For the image data of pattern image 102*c* for cyan, the value of the parameter (1) can be obtained replacing Ck by Cc in the above-described formula, which provides the liquid drop number of 5 for cyan.

For the image data of pattern image 102*m*, the value of the parameter (5) is calculated by the following formula and the number of liquid drops is determined:

$$(5)=\{L1-(Nk+Nc+Nm+Ny)\}\times Cm/\{(1)\times(1+(4))\}$$

$$=\{60-(1+1+1+1)\}\times 0.25/\{1\times(1+1)\}$$

$$=7.$$

Thus, the liquid drop number is determined to be 7. In this example, liquids are discharged with a resolution of 1 on 1 off of 1200 dpi and a driving frequency corresponding to a half of the highest driving frequency. It is preferable because a stability of the discharging can be secured when a volume of liquid drops for the flushing is large or when it is difficult to discharge liquid drops stably with a high speed and with the highest driving frequency. Moreover, patterns are not formed adjacent to each other in the width direction. Thus, a drying property of the liquid on the sheet material P is excellent.

The image data of pattern image 102*y* is obtained by discharging liquids with a resolution of 1 on 1 off of 1200 dpi. The length of the flushing region in the conveyance direction is 32 pixels. The value of the parameter (5) is calculated by the following formula and the number of liquid drops is determined:

$$(5)=32/\{(1)\times(1+(4))\}$$

$$=32/\{(1)\times(1+1)\}$$

$$=8.$$

Thus, the liquid drop number is determined to be 8. In this example, the pattern is coarse, and preferably applied to a type of a liquid or a sheet material P which are difficult to dry.

<Actions and Effects of the Image Forming Apparatus 1>

Next, actions and effects of the image forming apparatus 1 will be described.

Conventionally, an image forming apparatus has been known, in which a liquid receiving part such as a sponge is arranged in a region, where an image is not formed, between conveyed recording media, a thickened liquid is ejected by being discharged on the liquid receiving part so that the liquid in a head is refreshed, thereby a discharging operation of the head is maintained to be normal.

However, in the configuration in which the liquid receiving part is arranged between recording media, a waste liquid in the liquid receiving part may become a full state in a short period of time, and a labor and a cost for replacing the liquid receiving part may increase.

On the other hand, an image forming apparatus has been known, in which a margin region that becomes a margin when an image is formed on a recording medium is specified based on a predetermined pattern data, a liquid is ejected by being discharged on the region, so as to remove an interruption of the image formation, in order to enhance an image forming speed.

However, characteristics of a liquid, such as a drying property or wettability, differ due to a difference in a composition of the liquid. Accordingly, when a condition such as a cycle of discharging or an amount of the liquid to be discharged is fixed and liquids of different types are discharged, the effect of the flushing by discharging may be insufficient, and the amounts of the liquids to be discharged in the margin region may not be optimized for the respective types of the liquids. Moreover, because the amount of liquid to be discharged in the flushing differs depending on a size of the margin region, when being short of the liquid to be discharged, a sufficient effect of the flushing may not be obtained.

In the embodiment of the present application, a margin region that becomes a margin when an image is formed on a sheet material P is specified based on image data, and image data of a pattern image to be formed in the margin region are generated based on a size of the margin region and a type of the liquid. For example, sizes of patterns in the pattern images are determined for the respective types of the liquids.

Because the amount of the liquid to be discharged for forming the pattern image varies by the size of the pattern, the amount of the liquid can be optimized for each type of the liquid so as to obtain a sufficient effect of the flushing, by forming a pattern image in the margin region based on the image data generated as above. Thus, the flushing is preferably performed, and the liquid discharging head can be maintained in a normal state.

Moreover, because the amount of the liquid to be discharged may vary by a factor other than the size of the pattern, such as a density of the pattern in the pattern image, the amount of the liquid may not be controlled precisely only by determining the size of the pattern. In the embodiment of the present application, a number of liquid drops of the liquid is determined based on the size of the margin region and the type of the liquid. Thus, the density of the pattern in the pattern image or the like can be controlled, and thereby the amount of the liquid can be optimized more precisely.

Moreover, in the embodiment of the present application, a liquid receiving part is arranged between the plurality of conveyed recording media, and a pattern image can be formed on the margin region, the liquid receiving part, or both, for the flushing. Thus, even when a sufficient size of the margin region cannot be secured, by discharging the liquid on the liquid discharging unit, a sufficient amount of the liquid can be discharged, and the flushing effect can be preferably obtained.

Moreover, in the embodiment of the present application, the image data of the pattern image are generated by using parameters, and it is unnecessary to store image data of pattern images of various patterns in a storage device. Thus, it is possible to form the pattern image in the margin region or the liquid receiving part to perform the flushing without a storage device with a memory capacity sufficient for storing image data of pattern images.

Other Preferable Embodiments

In most of the image forming apparatuses, in order to enhance an image quality, liquid drops to be discharged for forming a print image on a sheet material P have a shape close to a sphere without a satellite and a shape taking into account an impact stability, i.e. when the liquid drop is impacted on the sheet material P, the liquid drop is difficult to rebound or deviate.

On the other hand, the flushing requires discharging liquid, which is difficult to be discharged due to a thickening or the like, with a strong force in order to accomplish the purpose of the flushing, i.e. refreshing the liquid in a head. However, the flushing does not require or restrict the shape of the liquid drop in particular.

Thus, in order to preferably accomplish the respective purposes, the shape of the liquid drops to be discharged for forming a print image on a sheet material is preferably different from the shape of the liquid drops to be discharged for the flushing.

Moreover, a discharging speed of the liquid for forming the pattern image in the margin region is preferably different from a discharging speed of the liquid for forming an image in a plate other than the margin region. For example, the discharging speed for performing the flushing is greater than the discharging speed for forming the print image. The discharging speed of liquid refers to a speed of the liquid drop discharged from the head.

According to the above-described features, the image quality for forming a print image can be maintained, and the liquid that becomes difficult to be discharged can be discharged for performing the flushing. Thus, the flushing can be preferably performed.

When the liquid is discharged from the head, an electric voltage having a predetermined driving waveform is applied to the head. The driving waveform for forming the pattern image in the margin region may be different from the driving waveform for forming an image in a plate other than the margin region, so that the size of the liquid drops and the discharging speed are changed.

By changing the driving waveform, compared with the case of forming the print image, the size of the liquid drops for the flushing can be made larger, and the discharging speed of the liquid drops can be made higher. Thus, the liquid that becomes difficult to be discharged can be discharged, and thereby the flushing can be preferably performed.

As described above, preferred embodiments and practical examples of the present invention have been described in detail. However, the present invention is not limited to the embodiment or the practical examples, but various variations, modifications, replacements, additions, deletions, and combinations may be made without departing from the scope recited in claims.

For example, in the above embodiment, a line-scanning type ink jet image forming apparatus has been described as an example. However, the present invention is not limited to this. The embodiment of the present application can be applied to a serial scanning type ink jet image forming apparatus, and the same effect as in the above-described image forming apparatus 1 can be obtained.

Moreover, the coloring material is not limited to a liquid such as an ink, and may be a powder such as a toner. Thus, the embodiment of the present application may be applied to an electrophotographic image forming apparatus using a toner, and the same effect as in the above-described image forming apparatus 1 can be obtained.

Moreover, the embodiment of the present application includes a control method. For example, the control method is a method of controlling an image forming apparatus that forms an image with a coloring material on a recording medium, the method including a step of specifying a region that becomes a margin when the image is formed on the recording medium; and a step of generating image data of a pattern image to be formed in the region based on a size of the region and a type of the coloring material. According to the control method, the same effect as in the image forming apparatus 1 can be obtained.

Moreover, the embodiment of the present application also includes a non-transitory recording medium storing a program. For example, the program is a program used for the image forming apparatus that forms an image with a coloring agent on a recording medium, the program causes a computer to execute a processing of specifying a region that becomes a margin when the image is formed on the recording medium; and a processing of generating image data of a pattern image formed in the region based on a size of the region and a type of the coloring material. According to the program, the same effect as in the image forming apparatus 1 can be obtained.

Moreover, the respective functions of the embodiment of the present application described as above can be realized by a processing circuit or a plurality of processing circuits. The "processing circuit" in the specification of the present application includes a processor programmed so as to execute the respective functions by a software, such as a processor implemented by electronic circuits; or a device such as an ASIC (Application Specific Integrated Circuit), a DSP (Digital Signal Processor), an FPGA (Field Programmable Gate Array), or a conventional circuit module, designed so as to execute the respective above-described functions.

What is claimed is:

1. An image forming apparatus for forming an image with a coloring material on a recording medium comprising:

a region specifier that specifies a region that becomes a margin when the image is formed on the recording medium;

a pattern image generator that generates image data of a pattern image to be formed in the region based on a size of the region and a type of the coloring material; and a density determiner that determines a density of a pattern in the pattern image based on the size the region and the type of the coloring material.

2. The image forming apparatus according to claim 1, wherein the pattern image generator determines a size of a pattern in the pattern image for each type of the coloring material.

3. The image forming apparatus according to claim 1, wherein the coloring material is a liquid.

4. The image forming apparatus according to claim 3, wherein the pattern image generator determines a size of a pattern in the pattern image for each type of the liquid.

5. The image forming apparatus according to claim 3 further comprising:

a liquid drop number determiner that determines a number of liquid drops of the liquid based on the size of the region and the type of the liquid.

6. The image forming apparatus according to claim 3, wherein a liquid receiving part is arranged between a plurality of recording media that are conveyed, and wherein the image forming apparatus forms the pattern image in the region, the liquid receiving part, or both.

7. The image forming apparatus according to claim 3, wherein a discharging speed of the liquid for forming the pattern image in the region is different from a discharging speed of the liquid for forming the image in a place other than the region.

8. The image forming apparatus according to claim 7, wherein the discharging speed of the liquid for forming the pattern image in the region is greater than the discharging speed of the liquid for forming the image in the place other than the region.

9. The image forming apparatus according to claim 3, wherein a driving waveform for discharging the liquid for forming the pattern image in the region is different from a driving waveform for discharging the liquid for forming the image in a place other than the region.

10. A method of controlling an image forming apparatus for forming an image with a coloring material on a recording medium, the method comprising:

specifying a region that becomes a margin when the image is formed on the recording medium;

generating image data of a pattern image to be formed in the region based on a size of the region and a type of the coloring material; and determining a density of a pattern in the pattern image based on the size the region and the type of the coloring material.

11. A non-transitory computer-readable recording medium storing a computer program to cause a computer to perform a method of controlling an image forming apparatus for forming an image with a coloring material on a recording medium, the method comprising:

specifying a region that becomes a margin when the image is formed on the recording medium;

generating image data of a pattern image to be formed in the region based on a size of the region and a type of the coloring material; and determining a density of a pattern in the pattern image based on the size the region and the type of the coloring material.

12. An image forming apparatus for forming an image with a coloring material on a recording medium comprising:

a region specifier that specifies a region that becomes a margin when the image is formed on the recording medium;

a pattern image generator that generates image data of a pattern image to be formed in the region based on a size of the region and a type of the coloring material, wherein the coloring material is a liquid; and a liquid drop number determiner that determines a number of liquid drops of the liquid based on the size of the region and the type of the liquid.

13. The image forming apparatus according to claim 12, wherein the pattern image generator determines a size of a pattern in the pattern image for each type of the liquid.

14. The image forming apparatus according to claim 12, wherein a liquid receiving part is arranged between a plurality of recording media that are conveyed, and wherein the image forming apparatus forms the pattern image in the region, the liquid receiving part, or both.

15. The image forming apparatus according to claim 12, wherein a discharging speed of the liquid for forming the pattern image in the region is different from a discharging speed of the liquid for forming the image in a place other than the region.

16. The image forming apparatus according to claim 12, wherein a driving waveform for discharging the liquid for forming the pattern image in the region is different from a driving waveform for discharging the liquid for forming the image in a place other than the region.

17. An image forming apparatus for forming an image with a coloring material on a recording medium comprising:

a region specifier that specifies a region that becomes a margin when the image is formed on the recording medium;

a pattern image generator that generates image data of a pattern image to be formed in the region based on a size of the region and a type of the coloring material, wherein the coloring material is a liquid; and wherein a driving waveform for discharging the liquid for forming the pattern image in the region is different from a driving waveform for discharging the liquid for forming the image in a place other than the region.

18. The image forming apparatus according to claim 17, wherein the pattern image generator determines a size of a pattern in the pattern image for each type of the liquid.

19. The image forming apparatus according to claim 17, wherein a liquid receiving part is arranged between a plurality of recording media that are conveyed, and wherein the image forming apparatus forms the pattern image in the region, the liquid receiving part, or both.

20. The image forming apparatus according to claim 17, wherein a discharging speed of the liquid for forming the pattern image in the region is different from a discharging speed of the liquid for forming the image in a place other than the region.

* * * * *